US010913578B2

(12) United States Patent
Tan

(10) Patent No.: US 10,913,578 B2
(45) Date of Patent: Feb. 9, 2021

(54) TAMPER EVIDENT TAPE AND SEALED BAG ASSEMBLY FOR HANDLED BAGS AND METHOD

(71) Applicant: PAN PACIFIC PLASTICS MFG., INC., Hayward, CA (US)

(72) Inventor: Hin Siang Michael Tan, Danville, CA (US)

(73) Assignee: PAN PACIFIC PLASTICS MFG., INC., Hayward, CA (US)

( * ) Notice: Subject to any disclaimer, the term of this patent is extended or adjusted under 35 U.S.C. 154(b) by 0 days.

(21) Appl. No.: 16/400,231

(22) Filed: May 1, 2019

(65) Prior Publication Data

US 2019/0352055 A1 Nov. 21, 2019

Related U.S. Application Data

(60) Provisional application No. 62/672,981, filed on May 17, 2018.

(51) Int. Cl.
*B65D 33/28* (2006.01)
*B65D 33/18* (2006.01)
(Continued)

(52) U.S. Cl.
CPC ..... *B65D 33/28* (2013.01); *B65D 33/1691* (2013.01); *B65D 33/18* (2013.01); *B65D 33/24* (2013.01); *B65D 2401/15* (2020.05)

(58) Field of Classification Search
CPC .... B65D 33/28; B65D 33/1691; B65D 33/18; B65D 33/24; B65D 2401/15
(Continued)

(56) References Cited

U.S. PATENT DOCUMENTS 2,128,196 A * 8/1938 Vogel ..... B65D 27/30 229/81
3,811,613 A 5/1974 Harrison
(Continued)

FOREIGN PATENT DOCUMENTS

CN 2347943 11/1999
DE 29500157 U1 * 2/1995 ..... B65D 33/20
(Continued)

OTHER PUBLICATIONS

Machine translation of DE-29500157-U1.*
(Continued)

*Primary Examiner* — Jes F Pascua
(74) *Attorney, Agent, or Firm* — Beyer Law Group LLP

(57) ABSTRACT

A tamper evident delivery bag assembly includes a first and second that each includes an upper section terminating at an upper edge of the first panel and an opposed upper edge of the second panel. The upper edges cooperate to define a bag opening into a content receiving region. The upper sections are movable between an opened condition and a closed condition, the closed condition where the upper edges are oriented in opposed, adjacent, relationship to one another. A handle is mounted to each upper section of the first and second panels, and each handle includes a pair of spaced-apart leg portions that are aligned adjacent one another when the upper sections are oriented in the closed condition. A single use closure tape is laterally mounted to the first panel upper section, and includes an upper lateral portion extending laterally above the first edge thereof in an unsealed condition. The tape upper lateral portion includes a pair of cutouts strategically aligned with the first leg portion of the first handle. The tape upper lateral portion can be folded over the second edge of the second panel such that an adhesive of the tape is brought into contact with the exterior surface of the second panel, substantially sealing the bag opening in a
(Continued)

sealed condition. The leg portions of the handles are received through the cutouts of the tape.

19 Claims, 16 Drawing Sheets

(51) Int. Cl.
*B65D 33/24* (2006.01)
*B65D 33/16* (2006.01)

(58) Field of Classification Search
USPC ..... 383/74
See application file for complete search history.

(56) References Cited

U.S. PATENT DOCUMENTS 5,608,949 A * 3/1997 Cooley ..... B65D 33/1691 24/30.5 L
9,630,748 B2 * 4/2017 Keller ..... B65D 31/10
2007/0292053 A1 12/2007 Lin
2019/0112116 A1 * 4/2019 Su ..... B65D 33/1691

FOREIGN PATENT DOCUMENTS

DE 102009007985 2/2010
EP 0515086 11/1992
JP 2017061324 A * 3/2017

OTHER PUBLICATIONS

International Search Report and Witten Opinion from International Application No. PCT/US2019/030891, dated Jul. 26, 2019.

* cited by examiner

TAMPER EVIDENT TAPE AND SEALED BAG ASSEMBLY FOR HANDLED BAGS AND METHOD

RELATED APPLICATIONS

This application claims priority under 35 U.S.C. § 119(e) from U.S. Provisional Patent Application No. 62/672,981 (Attorney Docket No. MTANP008P), filed May 17, 2018, which is entitled "TAMPER EVIDENT TAPE ASSEMBLY TO SEAL HANDLED BAGS", naming Tan as the inventor, and which is incorporated by reference in its entirety.

FIELD OF THE INVENTION

The present invention relates to handled bags, and more particularly, relates to single use, food service, sealable bags with integrated venting.

BACKGROUND OF THE INVENTION

Conventional lunch bag-shaped paper bags have been in use in the food industry since at least the commencement of take-out fast food services. These upper open ended paper bags are easy to open, fill and close, providing simple access to its contents.

More recently, handled paper and plastic bags are becoming more commonly used in food delivery. While the use of these handled paper and plastic bags continues to proliferate in the food service industry, especially with the recent growth of third party food delivery services, the potential for food tampering also increases. Both the food preparer/provider and the consumer would like assurance the food prepared has not in any manner been touched or tampered prior to the delivery.

Accordingly, it is desirable to provide a single use, handled paper or plastic delivery bag that is capable of being sealed in a manner that enables the end consumer assurance that the handled bag has not been opened, and that the prepared food therein has not been tampered with.

SUMMARY OF THE INVENTION

The present invention provides a tamper evident delivery bag assembly comprising a sheet-like first panel, an opposed sheet-like second panel, and a bottom gusset. Each the first and second panel includes an interior surface that faces the opposing panel and an exterior surface, and each panel further includes a respective upper section terminating at an upper first edge of the first panel and an opposed upper second edge of the second panel. The first and second edges cooperate to at least partially define a bag opening into a content receiving region extending between the bag opening, the panels and the bottom gusset. The upper sections are movable between an opened condition and a closed condition, the closed condition where the first and second edges generally oriented in opposed, adjacent, relationship to one another. The delivery bag assembly further includes a first handle mounted to the upper section of the first panel, and a pair spaced-apart first leg portions upstanding from the first edge. A second handle is mounted to the upper section second panel, and includes a pair spaced-apart second leg portions upstanding from the second edge. The first and second leg portions are generally aligned adjacent one another when the upper sections are oriented in the closed condition. The present inventive delivery bag assembly further includes a single use closure tape member laterally mounted to the first panel upper section, and includes an upper lateral portion extending laterally above the first edge thereof in an unsealed condition. An adhesive is disposed on an interior surface of the tape upper lateral portion facing the second panels when in the unsealed condition. In accordance with the present invention, the tape upper lateral portion includes a pair of cutouts strategically aligned with the first leg portion of the first handle. A removable protective strip is provided that covers the adhesive until sealing is required. Hence, when the protective strip is removed, and the panel upper sections are aligned in the closed condition, the tape upper lateral portion can be folded over the second edge of the second panel such that the adhesive is brought into contact with the exterior surface of the second panel, substantially sealing the bag opening in a sealed condition. The leg portions of the first and second handles, thus, are received through the respective cutouts of the tape member.

Accordingly, a handled delivery bag assembly is provided that can be easily sealed to prevent evident tampering, yet provides steam venting of the contents. This bag assembly is particularly useful in the food delivery service industry.

In one specific embodiment, the lateral dimension of the cutouts is preferably in the range of about 15 mm to about 50 mm, and more preferably in the range of about 20 mm . . . .

In another embodiment, each the first panel and the second panel have respective first side edges cooperating with one another for securing therewith on one side of the bag assembly, and respective second side edges cooperating with one another for securing therewith on an opposite side of the bag assembly.

Another embodiment provides that when the adhesive is brought into contact with the external surface of the second panel, in the sealed condition, a vent is formed between an end of the tape member and the top of the first side edges of the panels. The vent is sufficiently large to enable the venting of steam there through while being sufficiently small to prevent the passage of a human hand there through.

Yet another specific embodiment provides a bag assembly with a first folded gusset disposed between, and mounted to the first side edges of the first and second panel, and a second folded gusset disposed between, and mounted to the second side edges of the first and second panel.

In still another specific embodiment provides a bag assembly is comprised of one of paper material and plastic material.

In one specific embodiment, the first and second handles are one of loop handles and folded handles.

Still another arrangement provides a tape member that includes a tear feature configured to facilitate tearing of the tape member to open the delivery bag, when in the sealed condition, to thereby provide access to the content receiving region of the delivery bag assembly. The tear feature includes scoring of the tape member.

The scoring may be in the form of letter-shaped slits, such as S-shaped cuts or S2G cuts.

In yet another specific embodiment, the first leg portion of the first handles is mounted to the respective exterior surface of the first panel, and the second leg portion of the second handles is mounted to the respective exterior surface of the second panel.

In another aspect of the present invention, a tamper evident tape member is provided to temporarily seal a bag opening of a delivery bag assembly having a sheet-like first panel, an opposed sheet-like second panel, and a bottom gusset, as described above. The tape member includes a single use closure tape member laterally mounted to the first panel upper section. The tape member includes an upper lateral portion extending laterally above the panel first edge in an unsealed condition. An adhesive disposed on an interior surface of the tape upper lateral portion facing the second panel when in the unsealed condition. The tape upper lateral portion includes a pair of cutouts strategically aligned with the leg portions of the first handle. A removable protective strip covers the adhesive. When this protective strip is removed, and the panel upper sections are aligned in the closed condition, the tape upper lateral portion can be folded over the second edge of the second panel such that the adhesive is brought into contact with the exterior surface of the second panel, substantially sealing the bag opening in a sealed condition. The leg portions of the first and second handles are received through the respective cutouts of the tape member.

In still another aspect of the present invention, a tamper evident method for delivering one or more food containers in a handled bag assembly is provided, comprising providing a handled delivery bag assembly having a sheet-like first panel, and an opposed sheet-like second panel. Each the first and second panel having an interior surface that faces the opposing panel and an exterior surface. Each panel further includes a respective upper section terminating at an upper first edge of the first panel and an opposed upper second edge of the second panel. The first and second edges cooperating to at least partially define a bag opening into a content receiving region extending between the bag opening and the first and second panels. The upper sections being movable between an opened condition and a closed condition. The bag assembly further includes a first handle mounted to the upper section of the first panel having a pair spaced-apart first leg portions upstanding from the first edge, and a second handle mounted to the second panel upper section having a pair spaced-apart second leg portions upstanding from the second edge. The first and second leg portions are generally aligned adjacent one another when the upper sections are oriented in the closed condition. The bag assembly further includes a single use closure tape member laterally mounted to the first panel upper section, and having an upper lateral portion extending laterally above the first edge thereof in an unsealed condition wherein the tape upper lateral portion having a pair of cutouts strategically aligned with the leg portions of the first handle. The method further includes reorienting the upper sections of the bag assembly to the opened condition to enable receipt of the one or more food containers in the content receiving region, and repositioning the upper sections of the bag assembly from the opened condition to the closed condition. This orients the first and second edges, and the leg portions of the handles, generally in opposed, adjacent, relationship to one another. Next, the method includes exposing a closure adhesive disposed on an interior surface of the tape upper lateral portion facing the second panel when in the unsealed condition, and folding the tape upper lateral portion over the second edge of the second panel such that the adhesive is brought into contact with the exterior surface of the second panel, substantially sealing the bag opening in a sealed condition. In this manner, the leg portions of the first and second handles are received through the respective cutouts of the tape member.

In one specific embodiment of this aspect of the present invention, the exposing the closure adhesive includes removing a protective strip from the closure adhesive.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawings, in which:

DETAILED DESCRIPTION OF THE INVENTION

Figure 1:
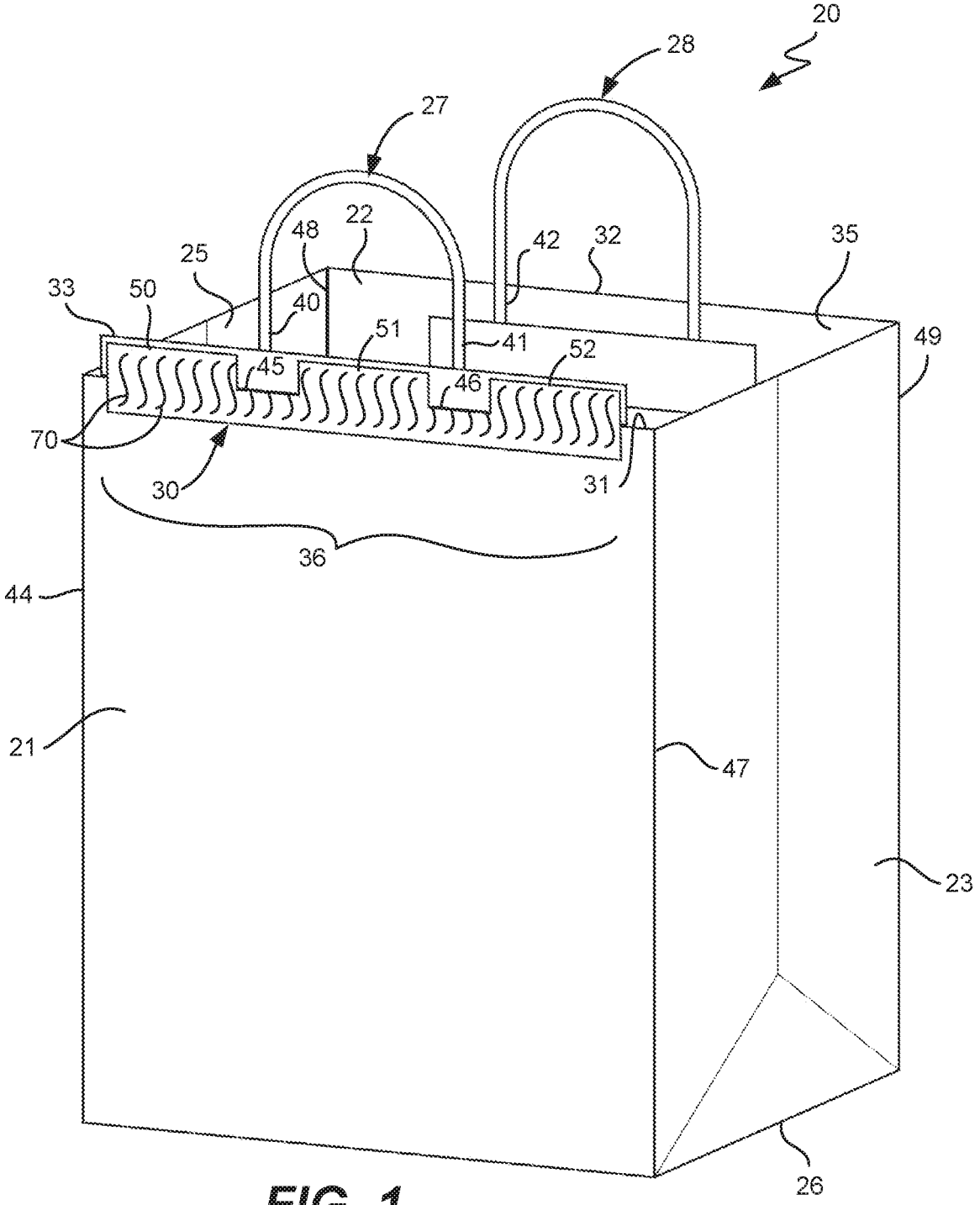
FIG. 1 is a front perspective view of a sealable, handled bag assembly constructed in accordance with the present invention with an upper section thereof in an opened condition.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 6:
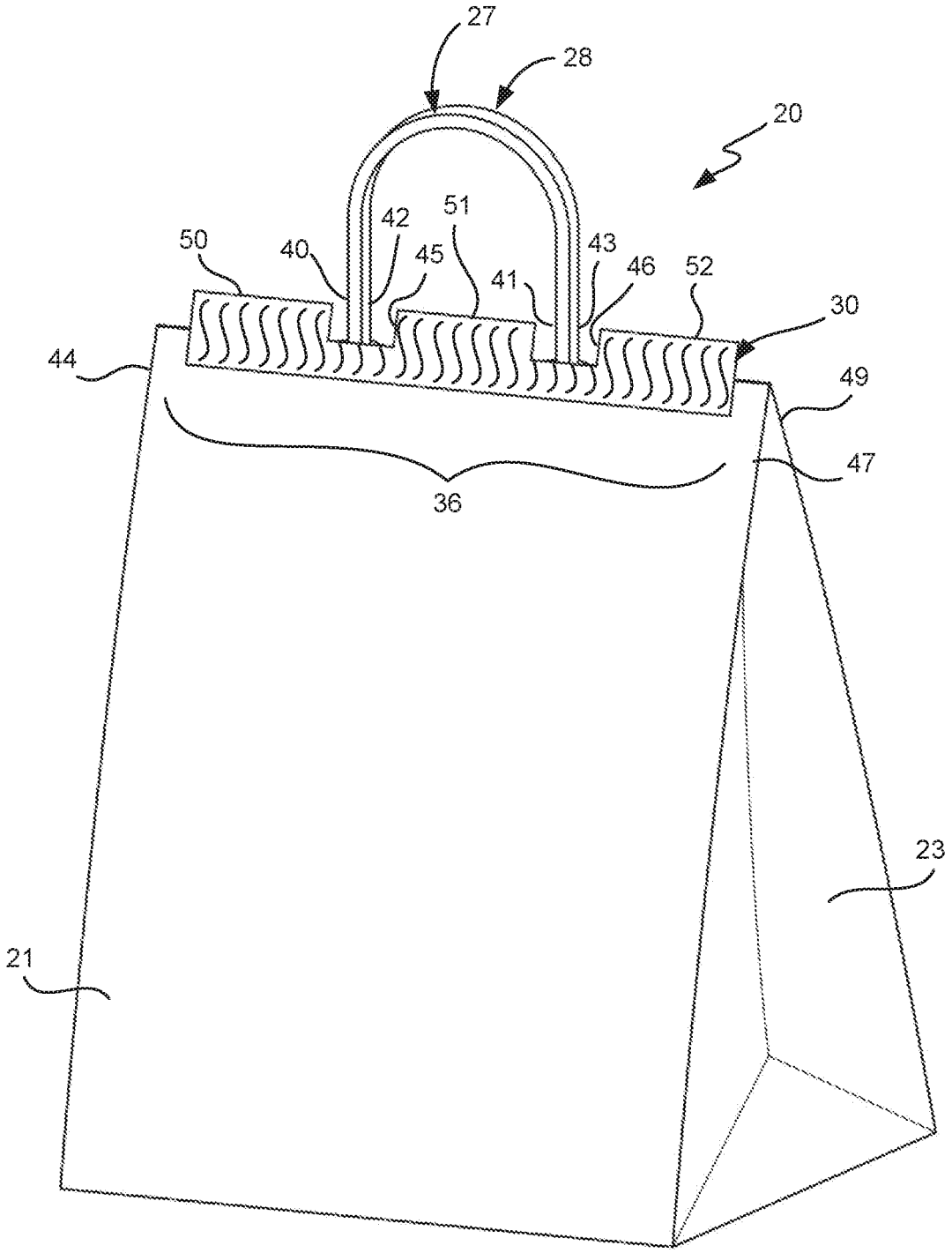
FIG. 6 is a front perspective view of the bag assembly of FIG. 5, illustrating an upper section thereof in a closed condition.
Figure 7:
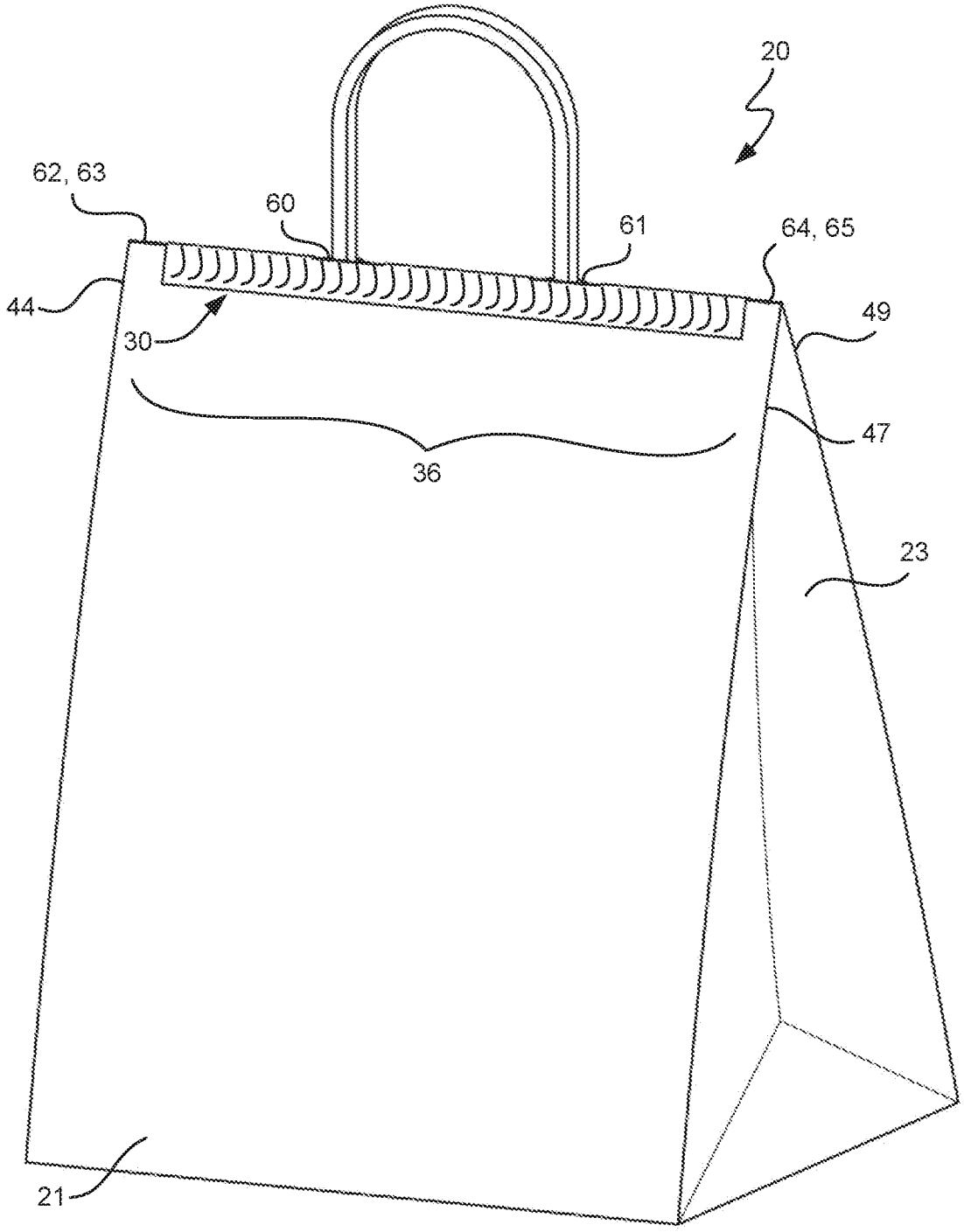
FIG. 7 is a front perspective view of the bag assembly of FIG. 6, illustrating the tape member in a sealed condition.
Figure 8:
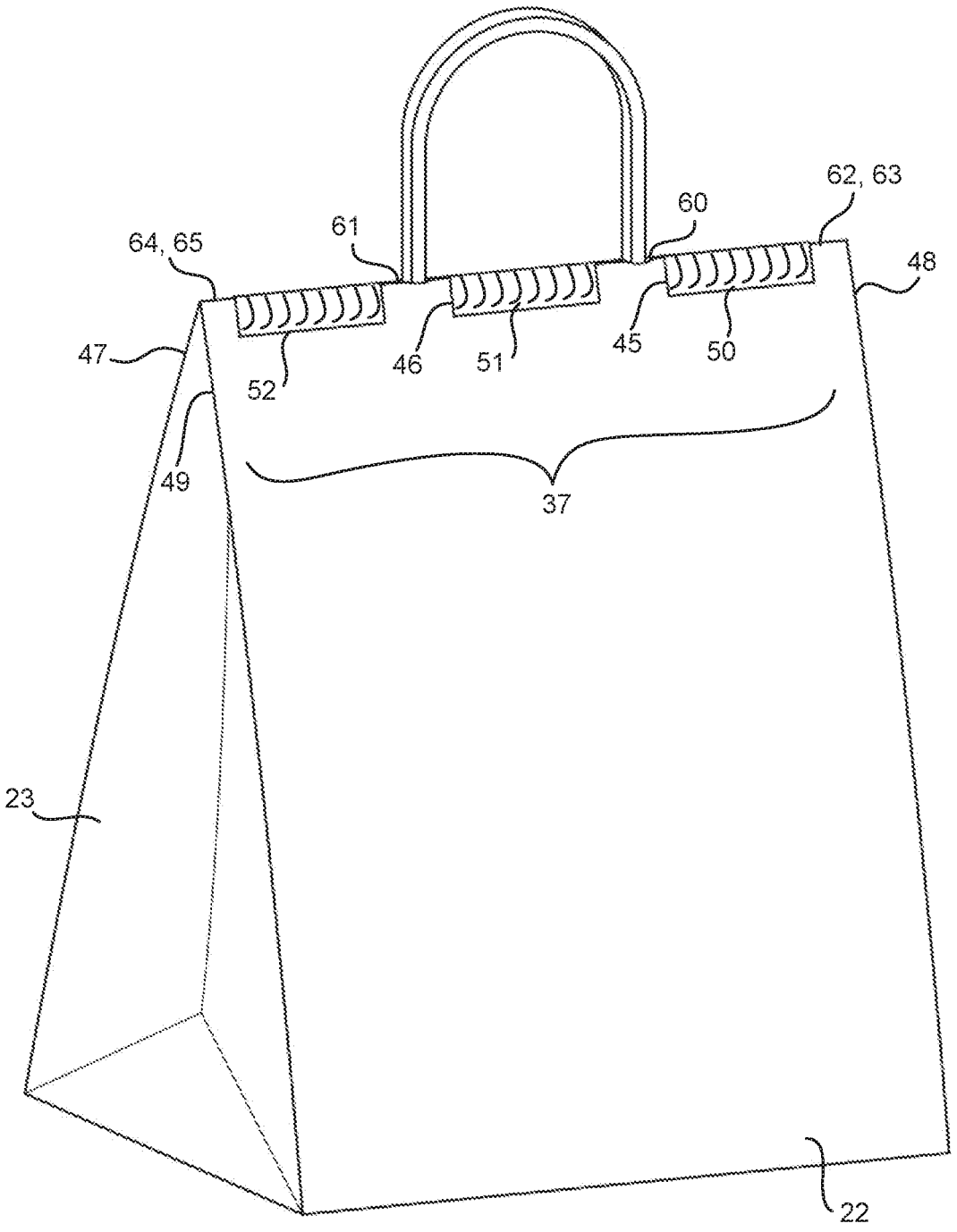
FIG. 8 is a rear perspective view thereof.
Figure 9:
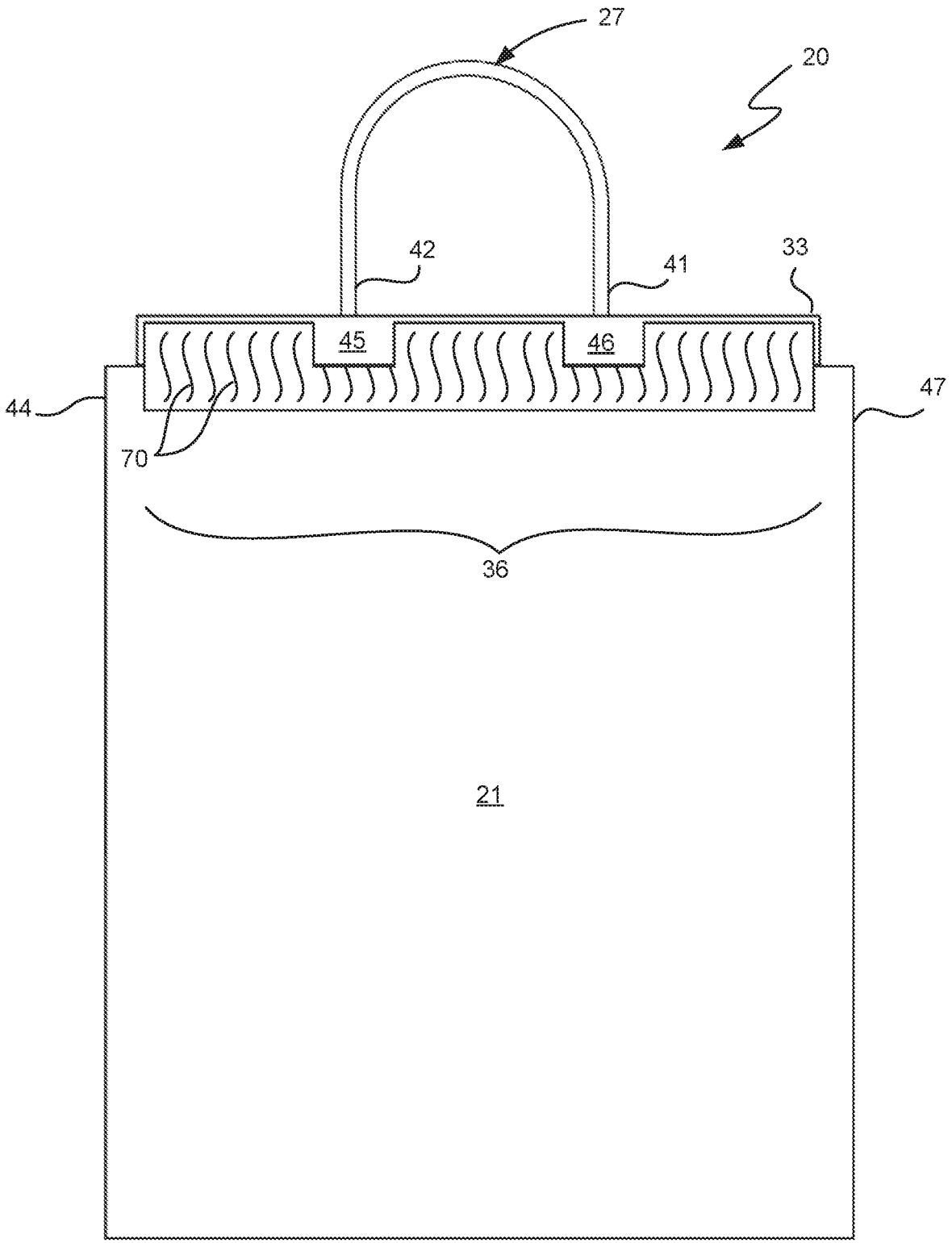
FIG. 9 is a front elevation view of the bag assembly of FIG. 1.
Figure 10:
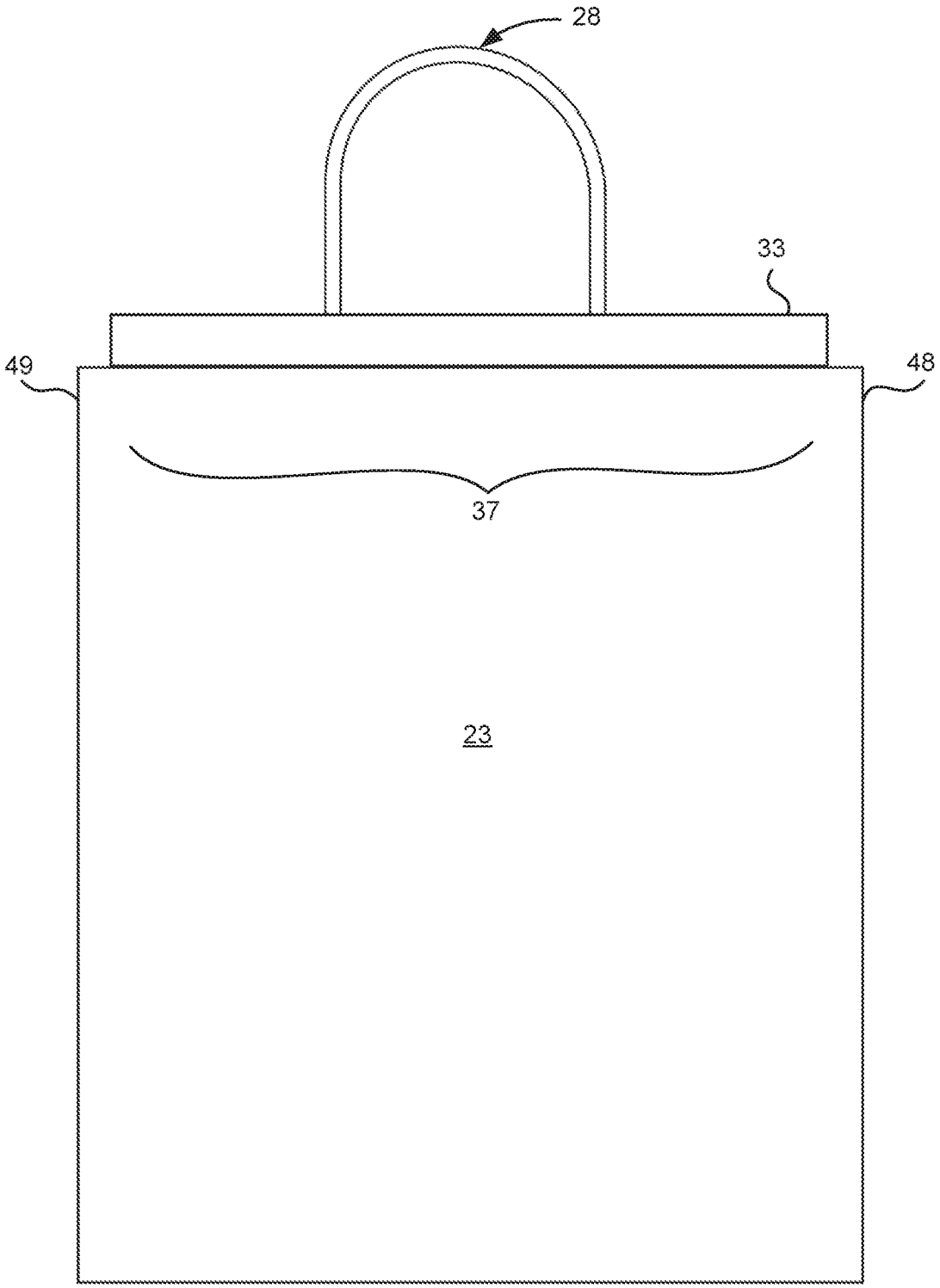
FIG. 10 is a rear elevation view thereof.
Figure 11:
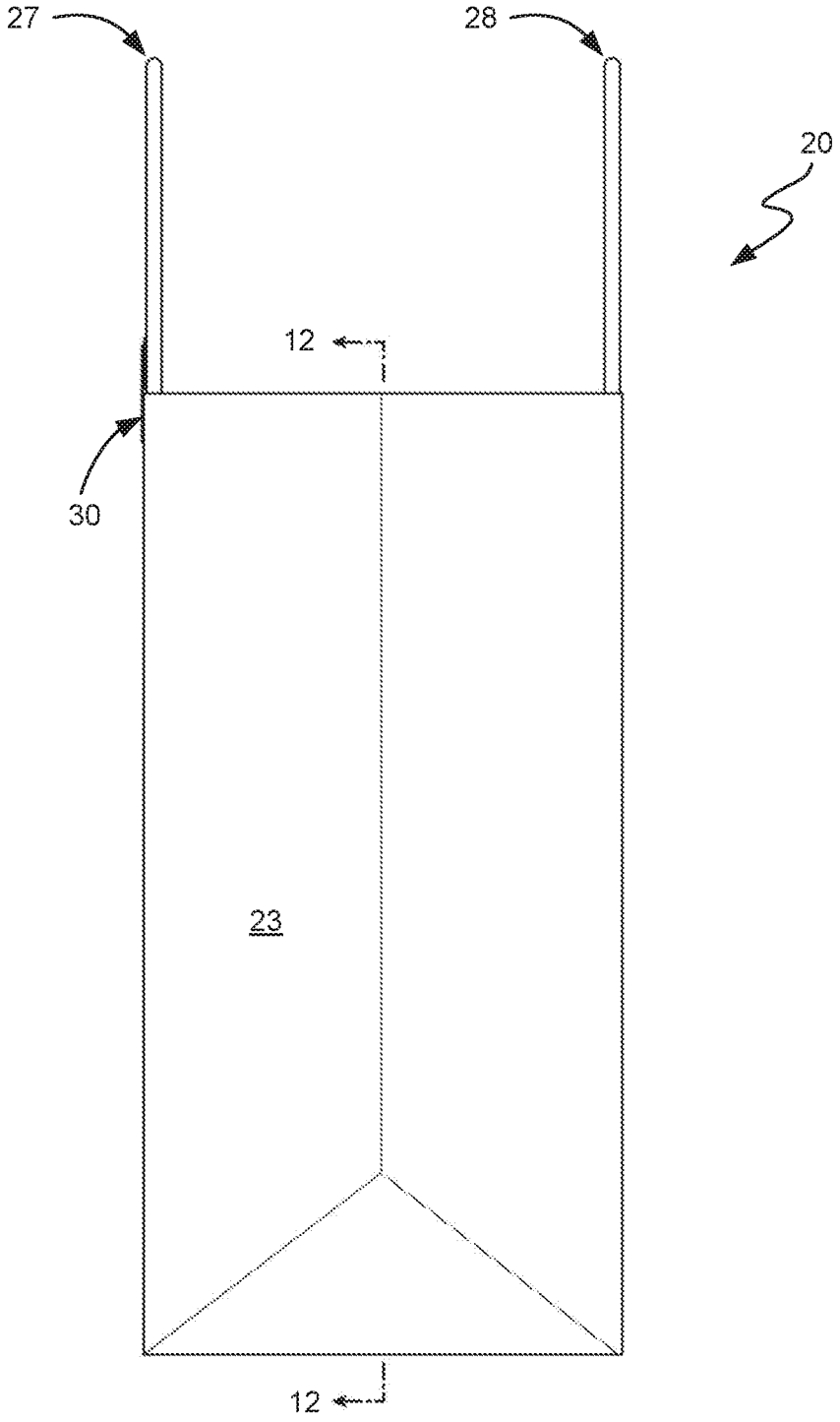
FIG. 11 is a right side elevation view of the bag assembly of FIG. 9.
Figure 12:
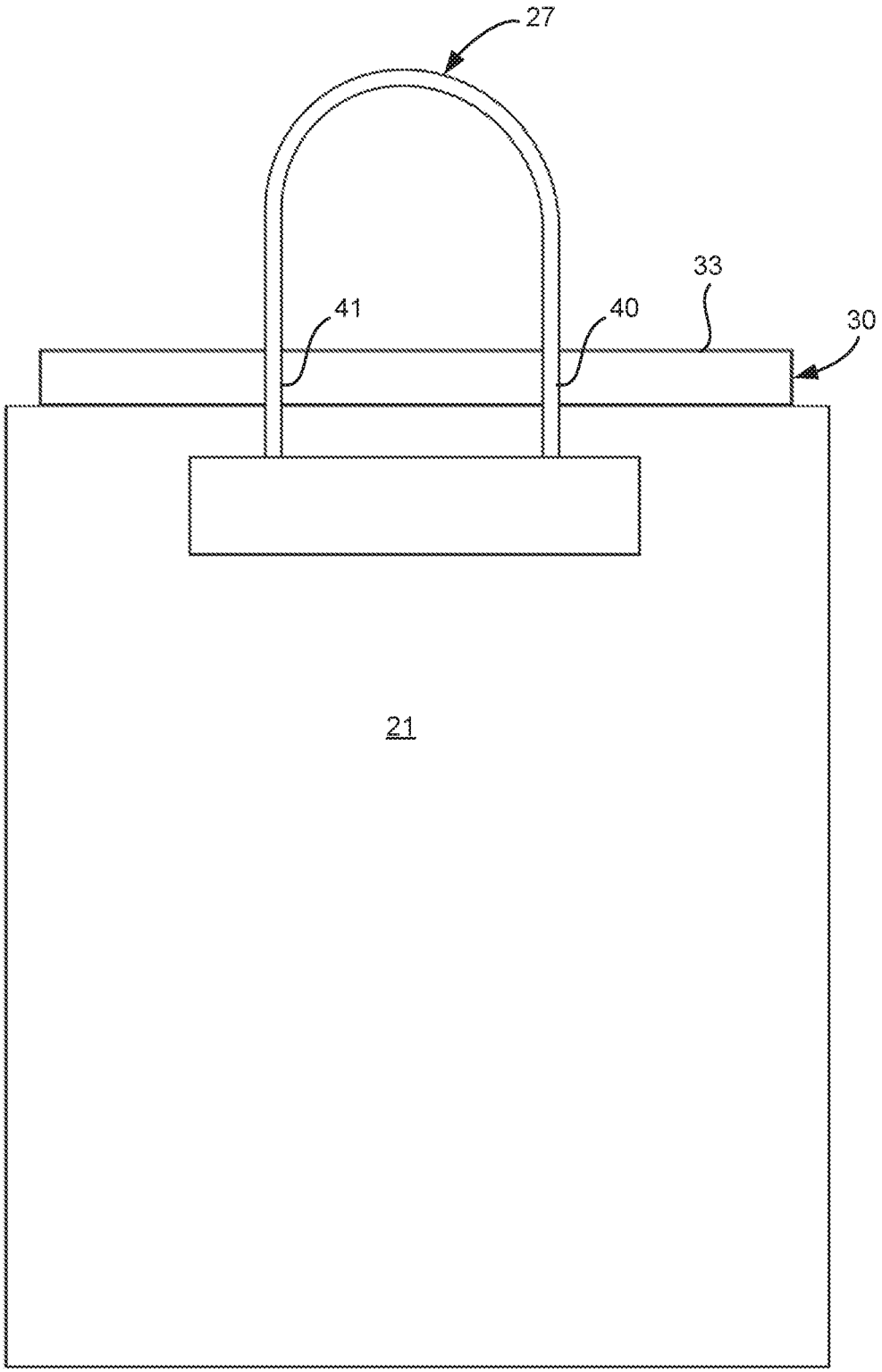
FIG. 12 is a fragmentary, rear elevation view taken along the plane of the line 12-12.
Figure 13:
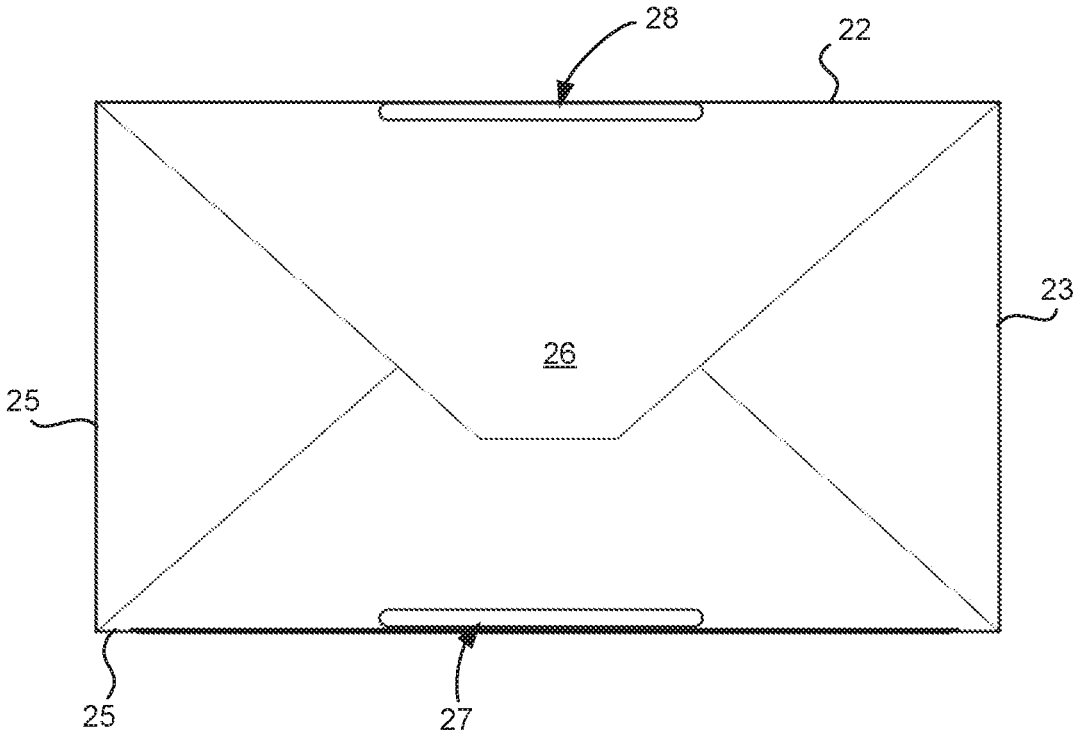
FIG. 13 is a top plan view thereof.
Figure 14:
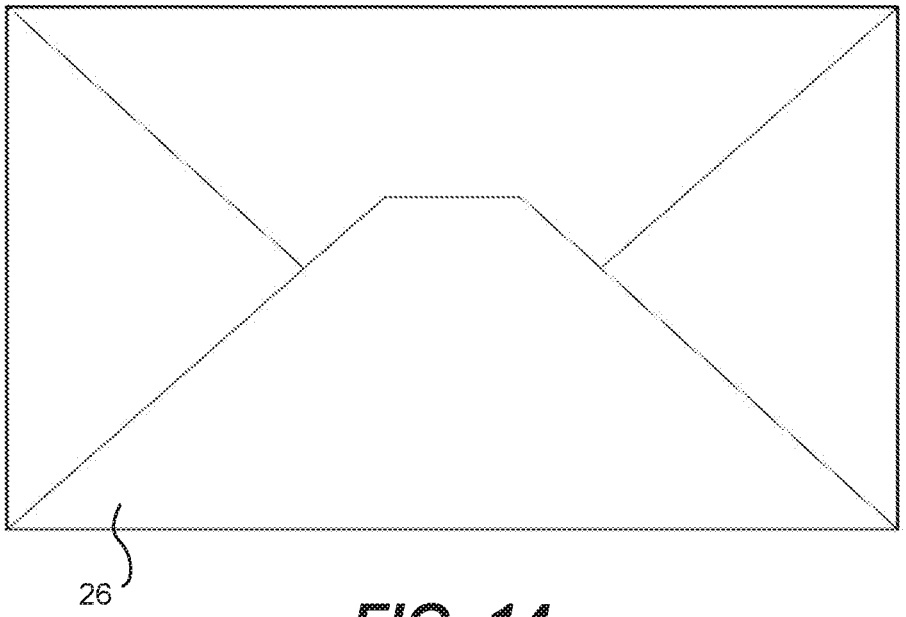
FIG. 14 is a bottom plan view thereof.

Turning now to FIGS. 1-8, a tamper evident delivery bag assembly, generally designated 20, is provided having a sheet-like first panel 21, an opposed sheet-like second panel 22, and a bottom gusset 26. Each the first and second panel 21, 22 having an interior surface that faces the opposing panel and an exterior surface. Moreover, each panel 21, 22 further includes a respective upper section 36, 37 terminating at an upper first edge 31 of the first panel 21, and an opposed upper second edge 32 of the second panel 22. The first and second edges 31, 32 cooperating to at least partially define a bag opening 35 into a content receiving region extending between the bag opening 35, panels 21, 22 and the bottom gusset 26. The upper sections 36, 37 being movable between an opened condition (FIGS. 1-5) and a closed condition (FIGS. 6-8), orienting the first and second edges 31, 32 generally in opposed, adjacent, relationship to one another. The bag assembly further includes a first handle 27 mounted to the upper section 36 of the first panel 21, and includes a pair spaced-apart first leg portions 40, 41 upstanding from the first edge 31. A second handle 28 is also included which is mounted to the upper section 37 of the second panel 22, and also includes a pair spaced-apart second leg portions 42, 43 upstanding from the second edge 32. The first and second leg portions 40, 41 and 42, 43 being generally aligned adjacent one another when the upper sections 36, 37 are oriented in the closed condition (FIGS. 6-8). In accordance with the present invention, the bag assembly further includes a single use closure tape member 30 laterally mounted to the first panel upper section 36, and having an upper lateral portion extending laterally above the first edge 31 thereof in an unsealed condition (FIGS. 1-6). The tape member 30 further includes an adhesive 38 (FIG. 3) disposed on an interior surface of the tape upper lateral portion facing the second panel 22 when in the unsealed condition. The tape upper lateral portion includes a pair of cutouts 45, 46 strategically aligned with the respective leg portions 40, 41 of the first handle 27. A removable protective strip 33 is provided that covers the adhesive 38. When the protective strip 33 is removed, and the panel upper sections 36, 37 are aligned in the closed condition (FIG. 3), the tape upper lateral portion can be folded over the second edge 32 of the second panel 22 such that the adhesive is brought into contact with the exterior surface of the second panel 22, substantially sealing the bag opening in a sealed condition (FIGS. 7 and 8). In this arrangement, the leg portions 40, 41 and 42, 43 of the first and second handles 27, 28 are received through the respective cutouts 45, 46 of the tape member 30.

Accordingly, a single-use, tamper evident delivery bag assembly is provided that can be one-time sealed in a manner that will exhibit visible signs of tampering and destruction should someone attempt to access its contents, yet provides venting of the contents simply by the positioning of the closure adhesive and seal in such a manner to create venting. This single-use bag assembly is particularly useful in the food delivery service industry since the size of the vent or vents, while providing venting of steam for example, is sufficiently small so that delivery personal cannot tamper with the bag contents without tearing of the bag or seal.

In accordance with the present invention, the delivery bag assembly 20 includes a fairly conventional handled bag assembly with the sheet-like first panel 21 and the opposed sheet-like second panel 22 either directly joined at the opposed panel side edges 44, 47 and 48, 49, forming common opposed side seams (not shown) or joined at respective panel side edges by an opposed pair of sheet-like, vertically creased, side gussets 23, 25 therebetween. The folded sheet-like bottom gusset 26 is coupled to the bottom edges of the first and second panels 21, 22, and the bottom edges of the opposed side gussets 23, 25. The respective interior surfaces of the first and second panels 21, 22, the side gussets 23, 25, and the bottom gusset 26 collectively define the content receiving region. Moreover, the pair of opposed handles 27, 28 are preferably provided by conventional twisted loop handles, flat plastic or paper folded handles (FIG. 15), rope handles, etc., that are widely available for easy carrying. These handles 27, 28 each include a pair of leg portions 40, 41 and 42, 43 which are mounted to either, the respective interior surface or the exterior surface of the respective upper sections 36, 37 of the first and second panels 21, 22.

Briefly, it will be appreciated that while the present invention is particularly suitable for conventional handled paper bags, this tamper evident seal assembly can be applied to plastic bags as well as any other conventional bag materials utilized in the food delivery industry. Moreover, while the present invention is shown with bag assemblies with two handles, one mounted to each panel, it will be appreciated that the present invention applies to bag assemblies with only a single handle (e.g., only a single handle 27 mounted to the first panel 21, and no second handle 28 mounted to the second panel 22).

Figure 2:
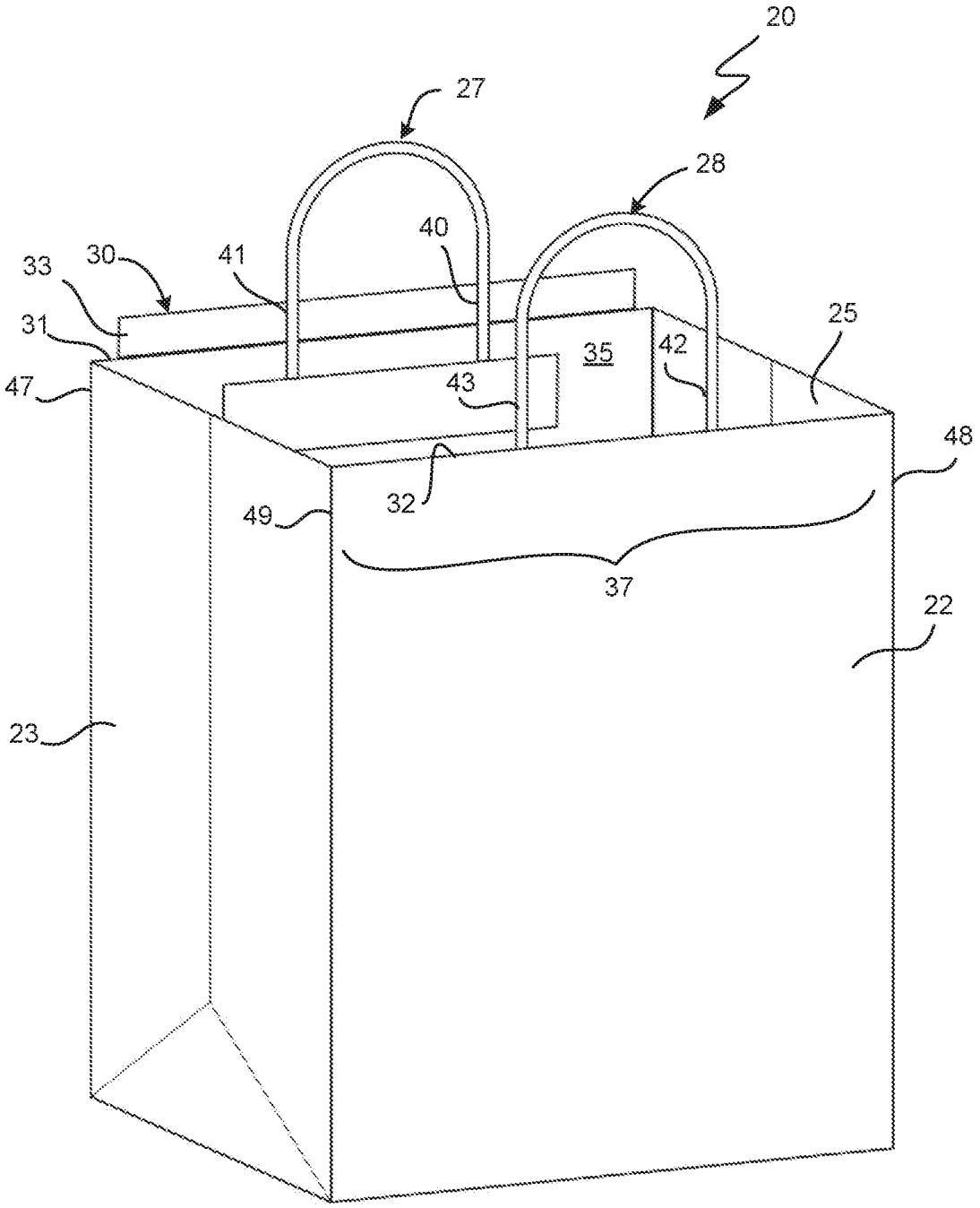
FIG. 2 is a rear perspective view of the bag assembly of FIG. 1, illustrating a tape member in an unsealed condition.
Figure 3:
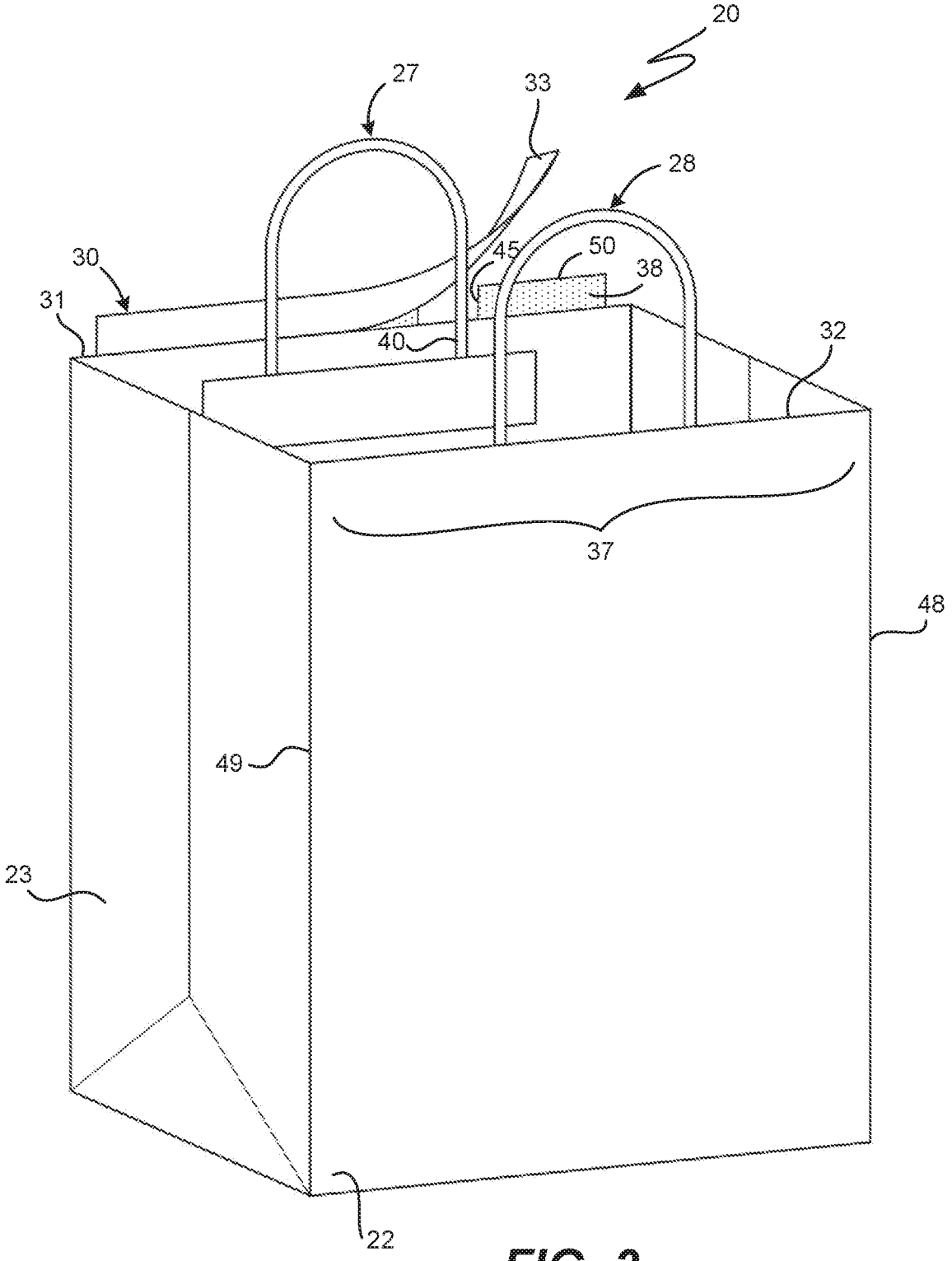
FIG. 3 is a rear perspective view thereof, illustrating removal of a protective strip from an adhesive of the tape member
Figure 4:
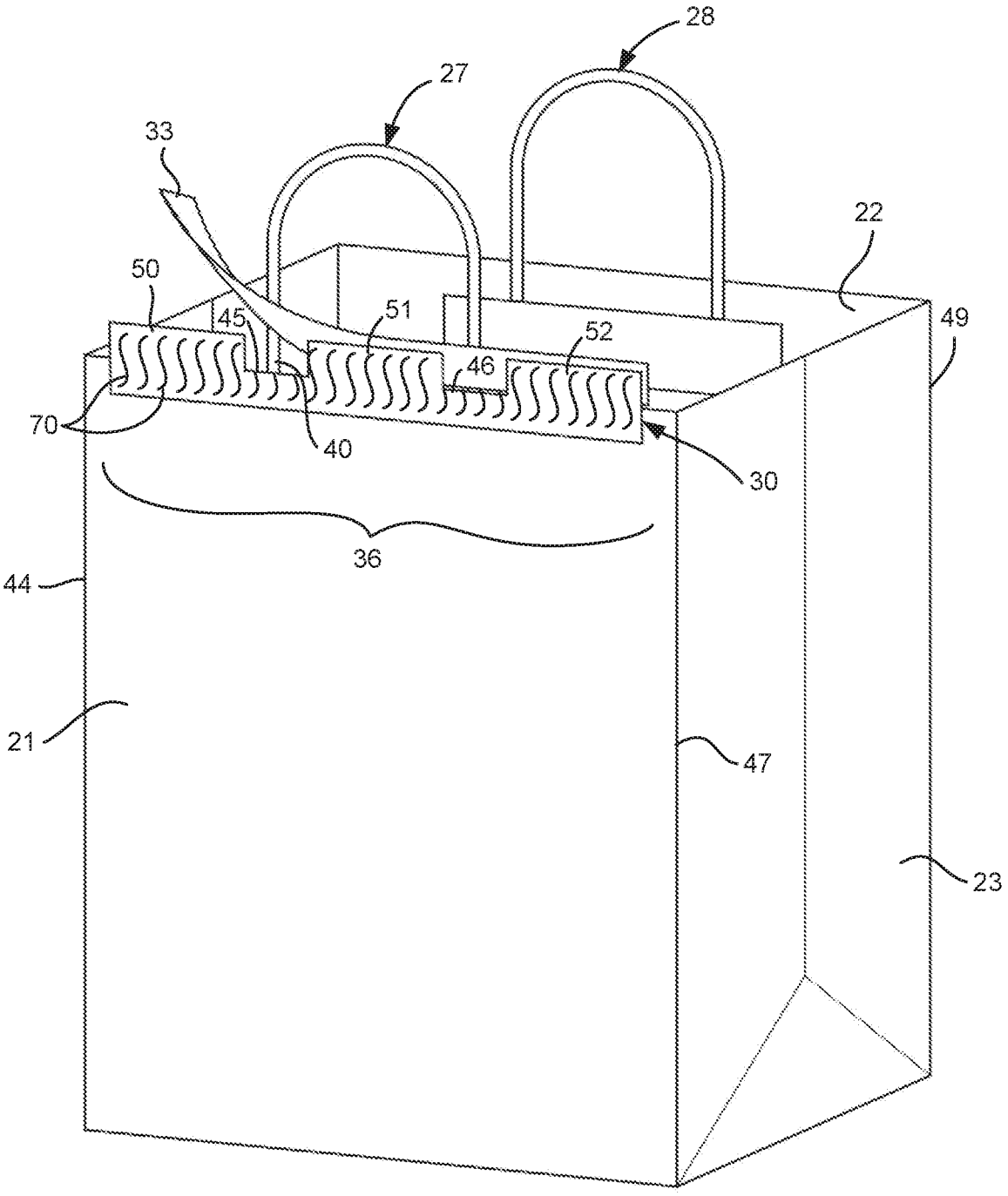
FIG. 4 is a front perspective view of the bag assembly of FIG. 3.
Figure 5:
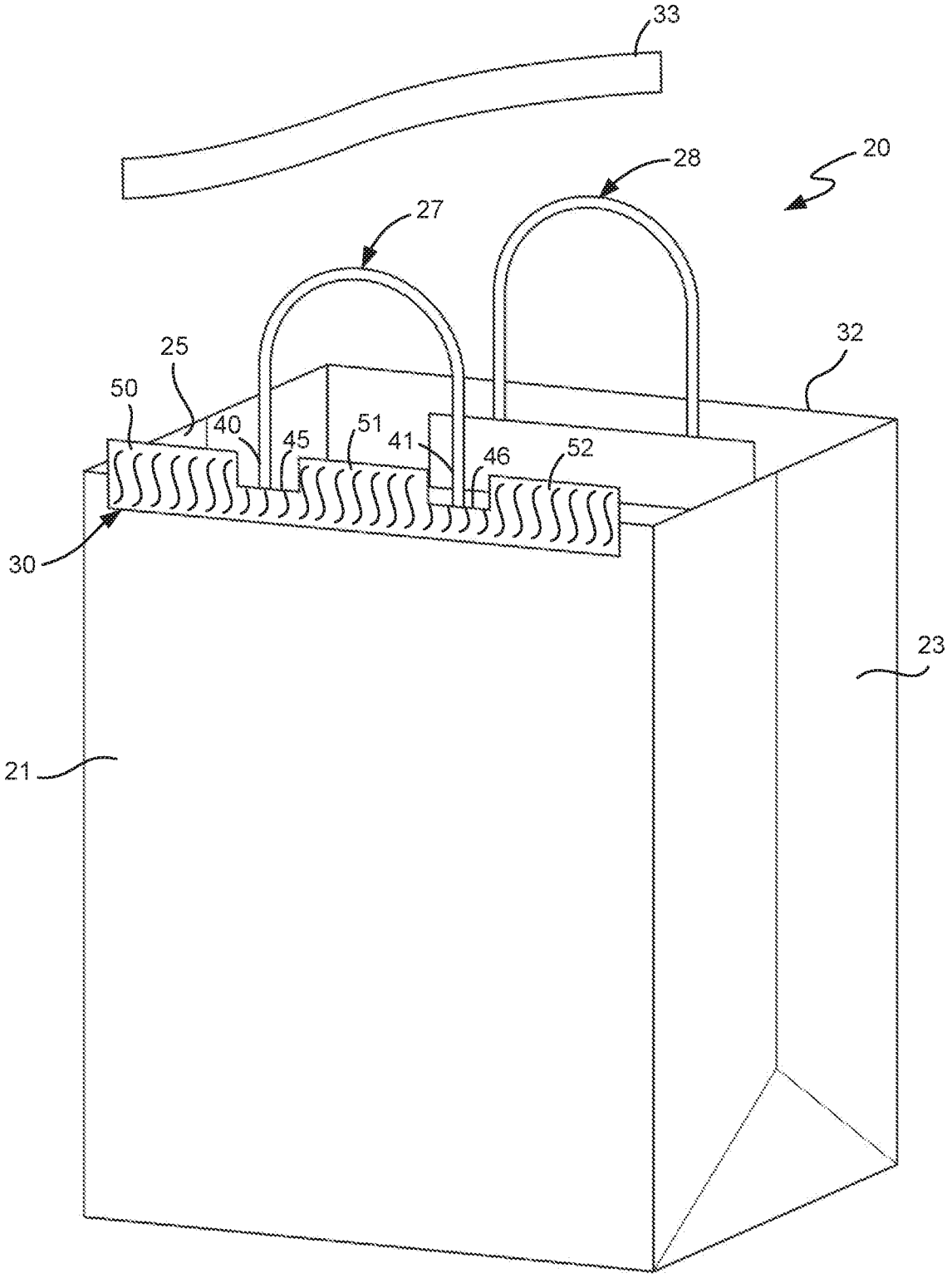
FIG. 5 is an exploded, front perspective view of the bag assembly of FIG. 4, illustrating the protective strip fully removed.
Figure 15:
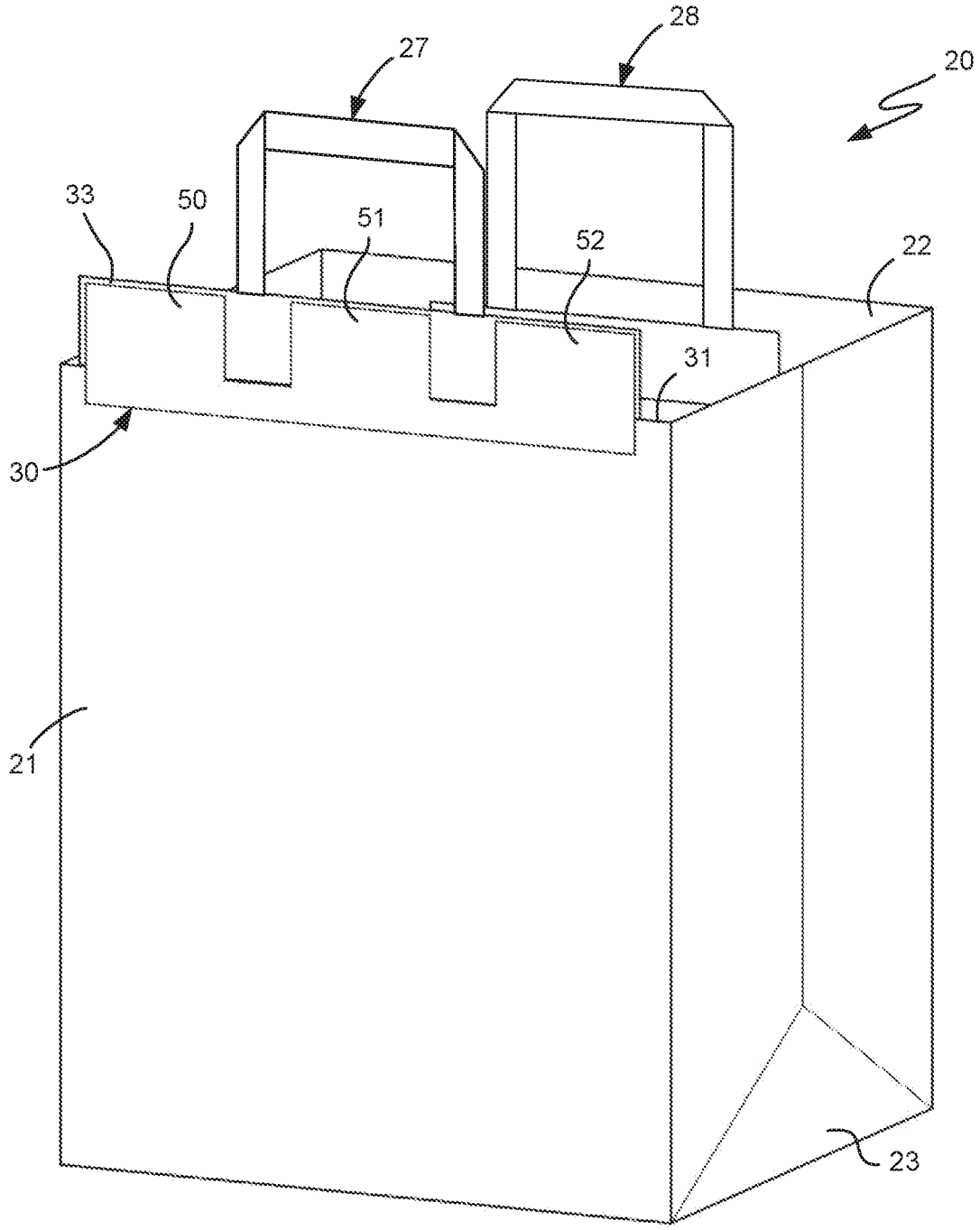
FIG. 15 is an alternative embodiment sealable bag assembly.
Figure 16:
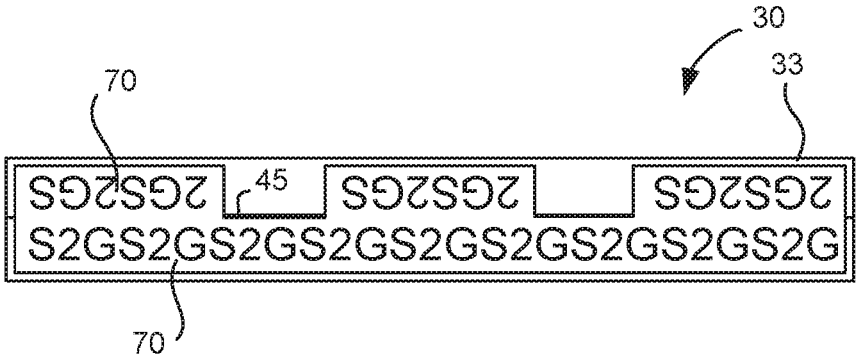
FIG. 16 is a top plan view of the tape member.
Figure 17:
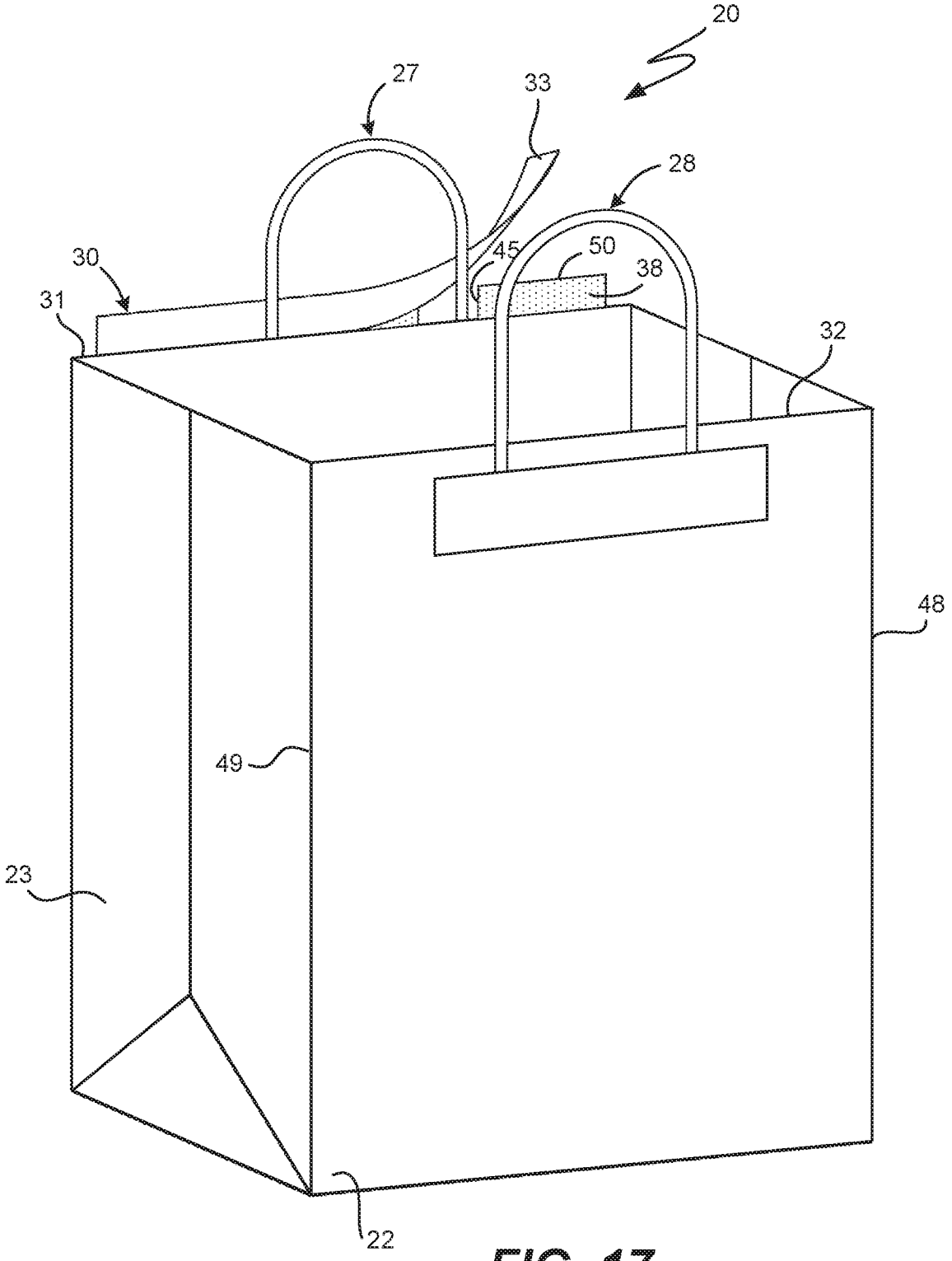
FIG. 17 is rear perspective view of an alternative embodiment of the bag assembly of FIG. 1.

Referring now to FIGS. 1, 2 and 16, the bag assembly 20 includes an elongated, single-sided adhesive or tape member 30 mounted to the exterior surface, and at the first and second edges 31, 32 of either the sheet-like first and second panel 21, 22. For the sake of clarity, the tape member will be described with reference to mounting, initially, only to the exterior surface of the first panel 21, although it will be appreciated that the tape member could be mounted to the exterior surface of the second panel 22 or to either interior surfaces thereof. Hence, the elongated tape member 30 is initially adhered or mounted to the exterior surface of the first panel 21, extending laterally along the corresponding upper first edge 31 thereof. In general, less than about one-half of the tape member 30 (i.e., a lower lateral portion thereof) is positioned below the corresponding first edge of the first panel 21, while being mounted to exterior surface thereof. The remaining upper lateral portion of the tape member 30 extends above the corresponding first edge 31, in the unsealed condition (FIGS. 1-6), and is initially not mounted or adhered to anything other than its protective strip 33. In one example, as shown in FIGS. 1, 4-6 and 9, the height of the lower lateral portion (mounted to the exterior surface of the first panel 21) and that of the upper lateral portion of the tape member 30 are generally equal to one another. In another example, as shown in FIG. 15, the height of the upper lateral portion may be significantly higher than that of the lower lateral portion. For instance, the height of the lower lateral portion may be ½" while that of the upper lateral portion is 1½" above the first edge 31.

The remaining upper lateral portion of the tape member 30 is configured to be folded over the opposing second edge 32 of the second panel 22 (FIG. 5), when the opening 35 into the bag interior of the bag is positioned in a closed condition (FIG. 6), prior to sealing of the opening in a sealed condition (FIGS. 7 and 8). It will be appreciated that in this closed position, the opposed first and second edges 31, 32 of the sheet-like first and second panels 21, 22, as well as the handles 27, 28, will be oriented generally parallel to and adjacent one another.

Referring now to FIGS. 1 and 4-6, to accommodate the lower leg portions 40, 41, 42, 43 of the opposed handles 27, 28 that are mounted to the corresponding first and second panels 21, 22, the upper lateral portion of the tape member 30 includes corresponding cutouts 45, 46 aligned therewith. These aligned cutouts 45, 46 separate the remaining upper lateral portion into three closure sections 50, 51 and 52, enabling the tape upper lateral portion to be folded over the corresponding second edge 32 of the second panel 22. Accordingly, once the protection strip 33 has been removed (FIGS. 5 and 6), as will be described in greater detail below, the exposed adhesive 38 on each closure section of the tape member can be adhered to the corresponding exterior surface of the second panel upper section, thereby sealing the bag closed in a sealed condition (FIGS. 7 and 8).

It will be appreciated that the cutouts 45, 46 can be any shape, but must be sufficiently dimensioned to accommodate the lower leg portions 40-43 of the handles 27, 28 when the panel upper sections are oriented in the closed condition and the tape member is in the sealed condition. Moreover, it will be understood that integral cutout vent apertures 60, 61 into the bag interior are formed by the cutouts themselves when the tape member seals the bag opening (FIGS. 7 and 8). Thus, these vent apertures 60, 61 are essentially formed between the interior distal edges of the outer closure sections 50, 52 of the tape member 30 and the first and second edges 31, 32 of the corresponding panels 21, 22.

Further, the outer vent apertures 62-65 are formed by the spacing between the outer distal edges of the outer closure section 50, 52 of the tape member 30 and the corresponding opposed side edges of the first and second panels 21, 22. In this manner, when the outer closure sections 50, 52 of the tape member are sealed against the exterior surface of the second panel 22, the distal ends of the tape member 30 and the end creases of the corresponding folded side gussets 23, 25 form these four outer vent apertures 62-65. In contrast when the opposed side edges 44, 47 and 48, 49 of the panels 21, 22 are directly joined at side seams (not shown) whereby the upper side gussets are eliminated, only two outer vent apertures are formed between the outer distal edges of the tape outer closure section 50, 52 and the corresponding joined side edges of the panels.

Collectively, these vent apertures provide venting of contents sealed within the bag interior. This will of course assures proper steam venting of hot food content therein, for instance, when the bag assembly is being carried by the handles 27, 28. It will be appreciated, however, that each vent aperture or passage is of a lateral dimension sufficiently large to enable adequate venting of steam therethrough while being sufficiently small to prevent the passage of a human hand therethrough. These vent apertures are preferably in the range of opening to at least about 3.2 mm in diameter to no more than about 25.4 mm in diameter, and more preferably about 12.7 in diameter.

When the tape member 30 is folded over, using the adhesive 38 to seal off the bag opening, the bag assembly is temporarily closed while retaining the container contents in the content receiving region. The adhesive 38 of the tape member will maintain the closure of the bag assembly until forcibly opened and/or torn. Accordingly, a tamper evident seal is created, assuring both the food preparer/provider, the food delivery driver, and the customer that content contained in the bag assembly 20 has not been tampered with.

The character and properties of the adhesive of the closure tape member 30 is preferably similar to that of the relatively strong adhesives and adhesive tapes employed for those used on overnight delivery packages, for instance. That is, the adhesive strength must be sufficiently strong so that any attempt to open the sealed bag assembly would show visible signs of tampering (e.g., stretching, tearing, etc. of the bag material and/or closure adhesive). Suitable closure adhesive tape materials include, for example, 3M® 9086, 9888T, CT6348, 9088, 9088FL, and 55256 double-sided adhesive.

To prevent inadvertent closure or contact of the adhesive 38 of the remaining upper lateral portion of the tape member 30, as mentioned, the tape member 30 includes a manually removable protective strip 33 (FIGS. 1-4). Thus, the adhesive 38 of the closure sections 50, 51, and 52 are protected until needed and utilized. Generally, however, even when the protective strip is removed released from the tape member 30, the adhesive, when still oriented in the unsealed condition, will not inadvertently contact the exterior surface of the second panel 22 until the tape upper lateral portion is manually folded over the first and second edges of the bag, and sealed against the second panel.

In accordance with the present invention, a single unit protective strip 33 is applied, spanning the voids created by the cutouts 45, 46 of the upper lateral portion of the tape member. In this manner, the protective strip can be removed as one unit rather than removing three separate units. This significantly reduces the time and effort required to remove the protective strip during sealing the bag assembly 20.

In one configuration, the tape member 30 includes strategic cuts or scoring 70 (e.g., FIGS. 1, 4 and 16) to easily cause breakage of the tape member should removal of the tape be attempted. Such scoring, thus, easily shows any evidence of tampering due to visual separation of the scored portion of the tape member 30 should tampering of the tape member be attempted. While the scoring 70 is shown in the figures as a plurality of adjacent S-shaped slits that extend traversely across the tape member, the scoring marks can be provided by any convention designs. For example, the slits may be in the form of designs. In one specific example, more distinctive designs include lettering or the like, and can provide personal advertising such as the "S2G" design (Seal-2-Go) shown in FIG. 16.

In another aspect of the present invention, the tape member 30, alone, may be provided for mounting of the lower lateral portion of the tape member to the upper section 36 of the first panel 21 (FIG. 16). The tape member would be provided with pre-cut cutouts 45, 46 that are to be aligned with the leg portions 40, 41 of the first handle 27. In this configuration, the tape member includes a lower protective cover 34 similar to the protective strip 33 that protects an adhesive mounted to the lower lateral portion (not shown). This protective cover 34 may removed prior to aligned adhered mounting of the lower lateral portion to the first panel upper section 36 without requiring removal of the protective strip 33.

In still another aspect of the present invention, a method is provided for tamper evident delivering of one or more food containers in a handled bag assembly 20. The method includes providing a handled delivery bag assembly 20 having a sheet-like first panel 21, and an opposed sheet-like second panel 22. Each the first and second panel includes an interior surface that faces the opposing panel and an exterior surface. Each panel 21, 22 further includes a respective upper section 36, 37 terminating at an upper first edge 31 of the first panel and an opposed upper second edge 32 of the second panel. The first and second edges 31, 32 cooperate to at least partially define a bag opening 35 into a content receiving region extending between the bag opening and the first and second panels 21, 22. The upper sections 36, 37 are movable between an opened condition (FIGS. 1-5) and a closed condition (FIGS. 6-8), orienting the first and second edges 31, 32 generally in opposed, adjacent, relationship to one another. The bag assembly further includes a first handle 27 mounted to the upper section 36 of the first panel 21 having a pair spaced-apart first leg portions 40, 41 upstanding from the first edge 31, and a second handle 28 mounted to the upper section 37 of the second panel having a pair spaced-apart second leg portions 42, 43 upstanding from the second edge 32. The first and second leg portions are generally aligned adjacent one another when the upper sections 36, 37 are oriented in the closed condition (FIGS. 6-8). The bag assembly further includes a single use closure tape member 30 laterally mounted to the first panel upper section 36, and having an upper lateral portion extending laterally above the first edge 31 thereof in an unsealed condition (FIGS. 1-6) wherein the tape upper lateral portion having a pair of cutouts 45, 46 strategically aligned with the leg portions 40, 41 of the first handle 27. The method further includes reorienting the upper sections 36, 37 of the bag assembly 20 to the opened condition (FIGS. 1-5) to enable receipt of the one or more food containers in the content receiving region, and repositioning the upper sections of the bag assembly from the opened condition to the closed condition (FIGS. 6-8). This orients the first and second edges, and the leg portions of the handles, generally in opposed, adjacent, relationship to one another. Next, the method includes exposing a closure adhesive 38 disposed on an interior surface of the tape upper lateral portion facing the second panel 22 when in the unsealed condition, and folding the tape upper lateral portion over the second edge 32 of the second panel 22 such that the adhesive is brought into contact with the exterior surface of the second panel, substantially sealing the bag opening 35 in a sealed condition (FIGS. 7 and 8). In this manner, the leg portions 40-43 of the first and second handles are received through the respective cutouts 45, 46 of the tape member 30.

In one specific embodiment of this aspect of the present invention, the exposing the closure adhesive 38 includes removing a protective strip 33 from the closure adhesive.

While the present invention has been described in connection with the preferred form of practicing it and modifications thereto, those of ordinary skill in the art will understand that many other modifications can be made thereto within the scope of the claims that follow. Accordingly, it is not intended that the scope of the invention in any way be limited by the above description, but instead be determined entirely by reference to the claims that follow.

What is claimed is:

1. A tamper evident delivery bag assembly comprising:

a sheet-like first panel, an opposed sheet-like second panel, and a bottom gusset, each the first and second panel having an interior surface that faces the opposing panel and an exterior surface, each panel further including a respective upper section terminating at an upper first edge of said first panel and an opposed upper second edge of said second panel, said first and second edges cooperating to at least partially define a bag opening into a content receiving region extending between the bag opening, panels and the bottom gusset, said upper sections being movable between an opened condition and a closed condition, orienting said first and second edges generally in opposed, adjacent, relationship to one another;

a first handle mounted to the upper section of the first panel having a pair spaced-apart first leg portions upstanding from said first edge, a second handle mounted to the upper section of the second panel having a pair spaced-apart second leg portions upstanding from said second edge, said first and second handles together with said first and second leg portions being generally aligned adjacent one another and collectively defining a gripping passage therethrough when said upper sections are oriented in said closed condition;

a single use closure tape member laterally mounted to the first panel upper section, and having an upper lateral portion extending laterally above said first edge thereof in an unsealed condition, said tape member further including an adhesive disposed on an interior surface of the tape upper lateral portion facing said second panel when in the unsealed condition, said tape upper lateral portion having a pair of cutouts strategically aligned with the leg portions of said first handle, and defining a middle closure section having a closure height extending vertically from said first edge to an upper edge of said middle closure section, said closure height being significantly less than a vertical height of said gripping passage; and a removable protective strip that covers the adhesive, wherein, when the protective strip is removed, and said panel upper sections are aligned in said closed condition, said tape upper lateral portion can be folded over the second edge of said second panel such that said middle closure section passes unobstructedly under the aligned handle members and through the gripping passage, and such that said adhesive is brought into contact with the exterior surface of said second panel, substantially sealing said bag opening in a sealed condition, and wherein said leg portions of the first and second handles are received through the respective cutouts of the tape member.

2. The tamper evident delivery bag as recited in claim 1 wherein said tape member includes a plurality of elongated scoring slits extending in a direction substantially transverse to the respective first and second edge of the respective first and second panel and across said bag opening when said upper sections are in said closed condition and said tape member is in said sealed condition.

3. The tamper evident delivery bag as recited in claim 2, wherein the lateral dimension of said cutouts is preferably in the range of about 15 mm to about 50 mm.

4. The tamper evident delivery bag as recited in claim 3, wherein the lateral dimension of said cutouts is more preferably in the range of about 20 mm.

5. The tamper evident delivery bag as recited in claim 2, wherein each said first panel and said second panel having respective first side edges cooperatively joined for securing therewith on one side of the bag assembly, and respective second side edges cooperatively joined for securing therewith on an opposite side of the bag assembly.

6. The tamper evident delivery bag as recited in claim 5, wherein when the adhesive is brought into contact with the external surface of the second panel, in the sealed condition, a vent is formed between an end of the tape member and the top of the first side edges of the panels.

7. The tamper evident delivery bag as recited in claim 6, wherein the vent is sufficiently large to enable the venting of steam there through while being sufficiently small to prevent the passage of a human hand there through.

8. The tamper evident delivery bag as recited in claim 6, wherein said bag assembly includes a first folded gusset disposed between, and mounted to said first side edges of the first and second panel, and a second folded gusset disposed between, and mounted to said second side edges of the first and second panel.

9. The tamper evident delivery bag as recited in claim 8, wherein said bag assembly is comprised of one of paper material and plastic material.

10. The tamper evident delivery bag as recited in claim 9 wherein said first and second handles are one of loop handles and folded handles.

11. The tamper evident delivery bag as recited in claim 2 wherein said scoring slits are in the form of at least one of a letter-shaped slit and a number-shaped slit.

12. The tamper evident delivery bag as recited in claim 11 wherein said letter-shaped slits is one of S-shaped cuts and S2G cuts.

13. The tamper evident delivery bag as recited in claim 2 wherein said first leg portions of said first handles is mounted to the respective interior surface of the first panel, and said second leg portions of said second handles is mounted to the respective interior surface of the second panel.

14. The tamper evident delivery bag as recited in claim 2 wherein said first leg portions of said first handles is mounted to the respective exterior surface of the first panel, and said second leg portions of said second handles is mounted to the respective exterior surface of the second panel.

15. The tamper evident delivery bag as recited in claim 1 wherein said closure height of the middle closure section is at least less than about ½ the vertical height of the gripping passage.

16. The tamper evident delivery bag as recited in claim 15 wherein said scoring slits are in the form of at least one of a letter-shaped slit and a number-shaped slit.

17. A tamper evident method for delivering one or more food containers in a handled bag assembly comprising:

providing a handled delivery bag assembly having a sheet-like first panel, and an opposed sheet-like second panel, each the first and second panel having an interior surface that faces the opposing panel and an exterior surface, each panel further including a respective upper section terminating at an upper first edge of said first panel and an opposed upper second edge of said second panel, said first and second edges cooperating to at least partially define a bag opening into a content receiving region extending between the bag opening and the first and second panels, said upper sections being movable between an opened condition and a closed condition, said bag assembly further including a first handle mounted to the upper section of the first panel having a pair spaced-apart first leg portions upstanding from said first edge, and a second handle mounted to the upper section second panel having a pair spaced-apart second leg portions upstanding from said second edge, said first and second handles together with the first and second leg portions being generally aligned adjacent one another and collectively defining a gripping passage therethrough when said upper sections are oriented in said closed condition, the bag assembly further including a single use closure tape member laterally mounted to the first panel upper section, and having an upper lateral portion extending laterally above said first edge thereof in an unsealed condition, said tape upper lateral portion having a pair of cutouts strategically aligned with the leg portions of said first handle, and defining a middle closure section having a closure height extending vertically from said first edge to an upper edge of said middle closure section, said closure height being significantly less than a vertical height of said gripping passage;

reorienting said upper sections of the bag assembly to the opened condition to enable receipt of the one or more food containers in the content receiving region;

repositioning said upper sections of the bag assembly from the opened condition to the closed condition, orienting said first and second edges, and the leg portions of said handles, generally in opposed, adjacent, relationship to one another;

exposing a closure adhesive disposed on an interior surface of the tape upper lateral portion facing said second panel when in the unsealed condition;

folding said tape upper lateral portion over the second edge of said second panel such that said middle closure section passes unobstructedly under the aligned handle members and through the gripping passage, and such that said adhesive is brought into contact with the exterior surface of said second panel, substantially sealing said bag opening in a sealed condition, and receiving said leg portions of the first and second handles through the respective cutouts of the tape member.

18. The tamper evident method according to claim 17, wherein said exposing the closure adhesive includes removing a protective strip from said closure adhesive.

19. A tamper evident delivery bag assembly comprising:

a sheet-like first panel, an opposed sheet-like second panel, and a bottom gusset, each the first and second panel having an interior surface that faces the opposing panel and an exterior surface, each panel further including a respective upper section terminating at an upper first edge of said first panel and an opposed upper second edge of said second panel, said first and second edges cooperating to at least partially define a bag opening into a content receiving region extending between the bag opening, panels and the bottom gusset, said upper sections being movable between an opened condition and a closed condition, orienting said first and second edges generally in opposed, adjacent, relationship to one another;

a first handle mounted to the upper section of the first panel having a pair spaced-apart first leg portions upstanding from said first edge, a second handle mounted to the upper section of the second panel having a pair spaced-apart second leg portions upstanding from said second edge, said first and second leg portions being generally aligned adjacent one another when said upper sections are oriented in said closed condition a single use closure tape member laterally mounted to the first panel upper section, and having an upper lateral portion extending laterally above said first edge thereof in an unsealed condition, said tape member further including an adhesive disposed on an interior surface of the tape upper lateral portion facing said second panel when in the unsealed condition, said tape upper lateral portion having a pair of cutouts strategically aligned with the leg portions of said first handle;

a removable protective strip that covers the adhesive, wherein, when the protective strip is removed, and said panel upper sections are aligned in said closed condition, said tape upper lateral portion can be folded over the second edge of said second panel such that said adhesive is brought into contact with the exterior surface of said second panel, substantially sealing said bag opening in a sealed condition, and wherein said leg portions of the first and second handles are received through the respective cutouts of the tape member; and said tape member includes a plurality of elongated scoring slits extending in a direction substantially transverse to the respective first and second edge of the respective first and second panel and across said bag opening when said upper sections are in said closed condition and said tape member is in said sealed condition.

* * * * *